United States Patent [19]

Fujita

[11] Patent Number: 4,976,917

[45] Date of Patent: Dec. 11, 1990

[54] METHOD OF MANUFACTURING HARDWEARING ALUMINUM ALLOY PART

[75] Inventor: Makoto Fujita, Hiroshima, Japan

[73] Assignee: Mazda Motor Corporation, Shinchi, Japan

[21] Appl. No.: 517,843

[22] Filed: May 2, 1990

[30] Foreign Application Priority Data

May 10, 1989 [JP] Japan ..... 1-116624

[51] Int. Cl.[5] ..... G22F 1/00

[52] U.S. Cl. ..... 419/33; 148/115 A; 148/12.7 A; 148/437; 419/62; 419/66

[58] Field of Search ..... 419/33, 62, 66; 148/437, 11.5 A, 12.7 A

[56] References Cited

U.S. PATENT DOCUMENTS 4,711,823 12/1987 Shiina ..... 419/29
4,734,130 3/1988 Adam et al. ..... 148/437
4,917,739 4/1990 Adam et al. ..... 148/437

FOREIGN PATENT DOCUMENTS 61-166931 1/1986 Japan .

*Primary Examiner*—Stephen J. Lechert, Jr.
*Attorney, Agent, or Firm*—Sixbey, Friedman, Leedom & Ferguson

[57] ABSTRACT

Quench-solidifed Al-Si alloy powder which contains more than 12 wt % Si is preformed, and the preforming is compression-molded into an aluminum alloy part. The aluminum alloy part is repeatedly subjected to a heating-and-cooling cycle of heating the aluminum alloy part to a temperature between 440° C. and 500° C. and cooling it to a temperature not higher than 380° C.

7 Claims, 5 Drawing Sheets

(UNTREATED)

(SIX CYCLES)

(TWELVE CYCLES)

METHOD OF MANUFACTURING HARDWEARING ALUMINUM ALLOY PART

BACKGROUND OF THE INVENTION

1. Field of the Invention

This invention relates to a method of manufacturing a hardwearing aluminum alloy part from quench-solidified Al-Si alloy powder.

2. Description of the Prior Art

Recently there has been put into practice a technique where a hardwearing aluminum alloy part is manufactured by hot-forging an extruded form which has been formed by extruding quench-solidified Al-Si alloy powder. Conventionally, when the hot forging is effected, the extruded form is heated to a temperature (400° to 500° C.) at which the extruded form can have adequate ductility and which is lower than the temperature at which Si particles remarkably coarsen (about 550° C.).

Since in the hardwearing aluminum alloy part formed of the quench-solidified Al-Si alloy powder, a higher a proportion of Si (20 to 30 wt %) alloys than in a cast aluminum alloy part (not higher than 18 wt %), the hardwearing aluminum alloy part is excellent in resistance to wear, and since the Si particles in the primary phase are very fine (not larger than 10 μm) in the hardwearing aluminum alloy part formed of the quench-solidified Al-Si alloy powder, the hardwearing aluminum alloy part formed of the quench-solidified Al-Si alloy powder is easy to plastically process and is excellent in strength.

However, the hardwearing aluminum alloy part formed of the quench-solidified Al-Si alloy powder is disadvantageous in that it is not so excellent in resistance to wear for its large Si content due to excessively fine Si particles in the primary phase.

In order to overcome such a disadvantage and to coarsen the Si particles, thereby improving the resistance to wear of the hardwearing aluminum alloy part formed of the quench-solidified Al-Si alloy powder, it has been proposed, as disclosed for instance in Japanese Unexamined Patent Publication No. 61(1986)-166931, to heat the extruded form of quench-solidified Al-Si alloy powder under conditions which satisfies the following formula.

$$T+40\log t \geqq 520$$

wherein T represents the heating temperature (°C.) and t represents the heating time (hour).

However, this approach gives rise to another problem that numbers of blisters are formed in the surface or near the surface of the aluminum alloy part due to residual gas in the powder which quickly expands since the powder is heated for a long time (e.g., 5 hours) at a high temperature (e.g., about 520° C.), and accordingly it is difficult to manufacture an aluminum alloy part for practical use. Further, since the approach requires a long heat treatment, too much heat energy is consumed.

SUMMARY OF THE INVENTION

In view of the foregoing observations and description, the primary object of the present invention is to provide a method of manufacturing a hardwearing aluminum alloy par from quench-solidified Al-Si alloy powder in which the Si particles can be coarsened in a short time at a relatively low temperature so that no blister is formed.

In accordance with the present invention, there is provided a method of manufacturing a hardwearing aluminum alloy part comprising the steps of preforming quench-solidified Al-Si alloy powder which contains more than 12 wt % Si, compression-molding the preforming into an aluminum alloy part, and repeating a plurality of times a heating-and-cooling cycle of heating the aluminum alloy part to a temperature between 440° C. and 500° C. and cooling it to a temperature not higher than 380° C.

For example, the quench-solidified Al-Si alloy powder may preformed by extrusion. The preforming may be compression-molded by, for instance, HIP molding, CIP molding, cold forging or hot forging.

The aluminum alloy part formed by the compression-molding is subjected to the heat treatment including the heating-and-cooling cycle of heating the aluminum alloy part to a temperature between 440° C. and 500° C. and cooling it to a temperature not higher than 380° C. as shown in FIG. 1.

Since the quench-solidified Al-Si alloy powder contains more than 12 wt % Si, the aluminum alloy of the aluminum alloy part contains a large number of fine Si particles in the primary phase, and the fine Si particles in the primary phase grow and agglomerate to form coarse particles when the aluminum alloy part is heated to a temperature between 440° C. and 500° C. The coarse Si particles are set for some reason when the aluminum alloy part is subsequently cooled to a temperature not higher than 380° C. As the heat treatment is repeated, growth of the Si particles is promoted and coarse Si particles which contributes to resistance to wear are formed in the aluminum alloy.

That the Si particles grow and agglomerate to form coarse particles even at a relatively low temperature between 440° C. and 500° C. has been empirically found. When the aluminum alloy part is heated above 500° C., residual gas in the powder will quickly expand and blisters will be formed in the surface or near the surface of the aluminum alloy part. Further, it has been found that the Si particles do not coarsen when the aluminum alloy part is cooled to a temperature higher than 380° C. after heated to a temperature between 440° C. and 500° C.

It is preferred that the heating time in the first heating-and-cooling cycle be about 30 minutes. The heating time in each of the subsequent cycles may be about 10 minutes. When the aluminum alloy part is cooled, it need not be held at the cooling temperature.

Preferably the repeating time by which the heating-and-cooling cycle is repeated is 5 to 10 though need not be limited to a particular value. As the repeating time increases, the Si particles better coarsen and the resistance to wear of the aluminum alloy part is more improved.

Though in the heat treatment in accordance with the present invention, the heating-and-cooling cycle is repeated a plurality of times, the total time requirement is only 2 to 3 hours and accordingly the heat energy consumption can be substantially reduced.

DESCRIPTION OF THE PREFERRED EMBODIMENT

Figure 2:
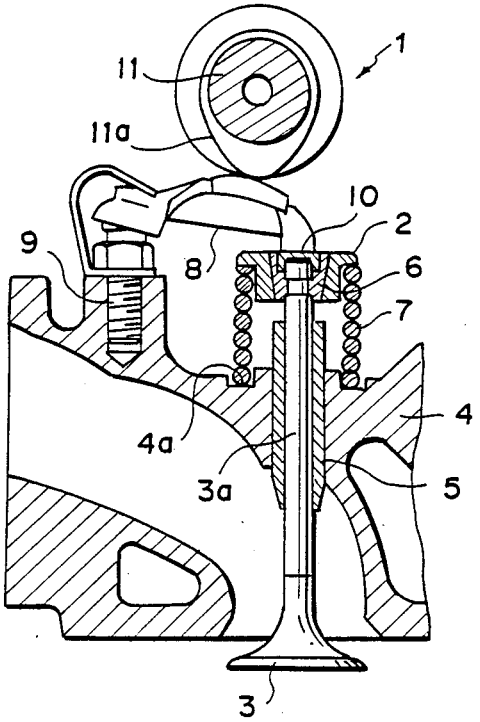
FIG. 2 is a cross-sectional view showing a valve train which includes a valve spring upper seat manufactured by the method of the present invention.
Figure 3:
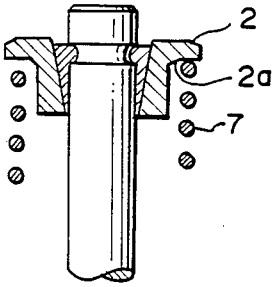
FIG. 3 is a cross-sectional view of the valve spring upper seat.

FIGS. 2 and 3 show a valve train 1 for driving an intake valve 3 of a vehicle. The intake valve 3 has a valve stem 3*a* which is fitted in a guide member 5 in a cylinder head 4 and is movable up and down. A valve spring upper seat 2 is mounted on the upper end portion of the valve stem 3*a* by way of a valve cotter 6. The upper end of a valve spring 7 which urges upward the intake valve 3 abuts against a spring retainer portion 2*a* of the valve spring upper seat 2 and the lower end of the valve spring 7 is supported on a spring retainer portion 4*a* of the cylinder head 4. An end of a rocker arm 8 is supported by an adjusting screw 9 so that its position can be adjusted, and the other end of the rocker arm 8 abut against a hardwearing cap member 10 on the top of the valve stem 3*a*. A cam 11*a* on a camshaft 11 abuts against the upper surface of the rocker arm 8. As is well known, the spring retainer portion 2*a* of the valve spring upper seat 2 is apt to wear since the intake valve 3 is moved up and down at a very high speed in response to revolution of the camshaft 11. Further, it is preferred that the valve spring upper seat 2 be as light as possible. That is, the valve spring upper seat 2 should be as light as possible and be excellent in resistance to wear.

Such a valve spring upper seat 2 was manufactured in the following procedure.

Figure 4A:
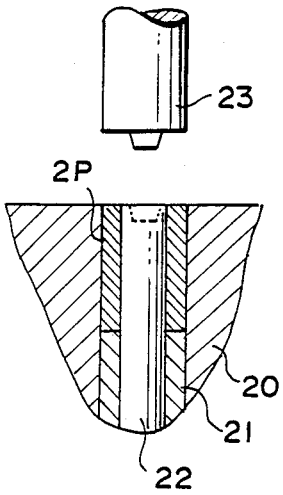
FIGS. 4*a* to 4*g* are views for illustrating the procedure of manufacturing a valve spring upper seat in accordance with an embodiment of the present invention.
Figure 4B:
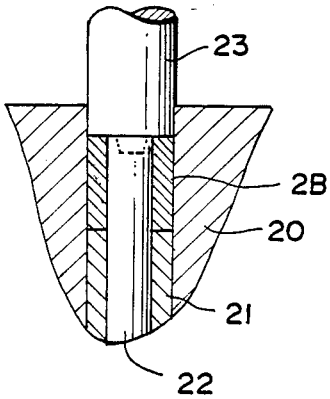
Figure 4C:
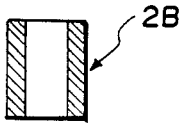

First quench-solidified Al-Si alloy powder containing 20 wt % Si, 2 wt % Cu, and 1 wt % Mg was prepared, and the powder was molded into a sleeve-like preforming 2B having a predetermined diameter and a predetermined length by the use of a powder molding machine comprising a lower die 20, a stationary core 21, a movable core 22 and an upper punch 23 in the manner shown in FIGS. 4*a* and 4*b*. Reference numeral 2P in FIG. 4*a* denotes the quench-solidified Al-Si alloy powder, and the sleeve-like preforming 2B is shown in FIG. 4*c*.

Figure 4D:
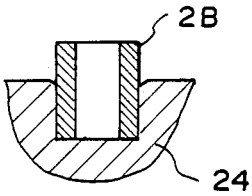
Figure 4E:
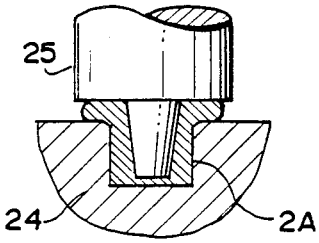

Thereafter, the preforming 2B was set to a lower die 24 of a forging machine as shown in FIG. 4*d*, and the preforming 2B was forged into a valve spring upper seat form 2A between the lower die 24 and an upper die 25 at a temperature between 440° C. and 500° C. as shown in FIG. 4*e*.

Figure 4F:
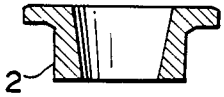

Then the valve spring upper seat form 2A was machined into a valve spring upper seat 2 of a predetermined shape shown in FIG. 4*f*.

Figure 1:
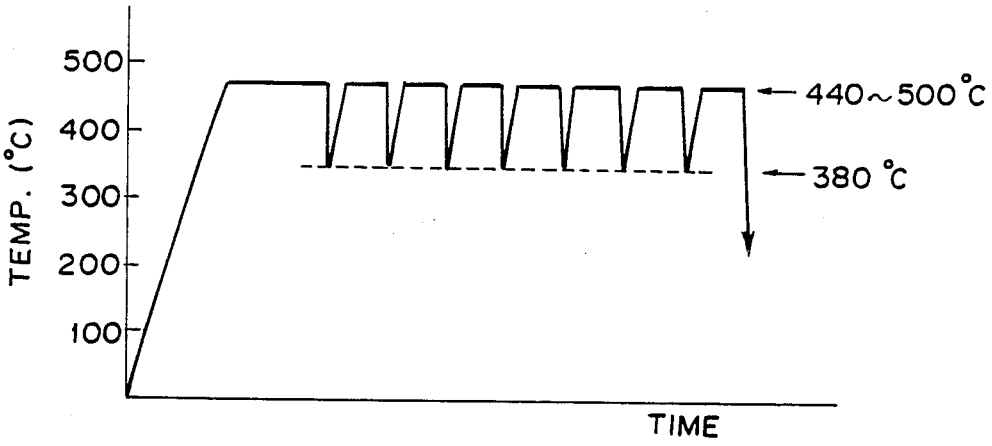
FIG. 1 is a view for illustrating the heat treatment which is effected in the method of the present invention.
Figure 5:
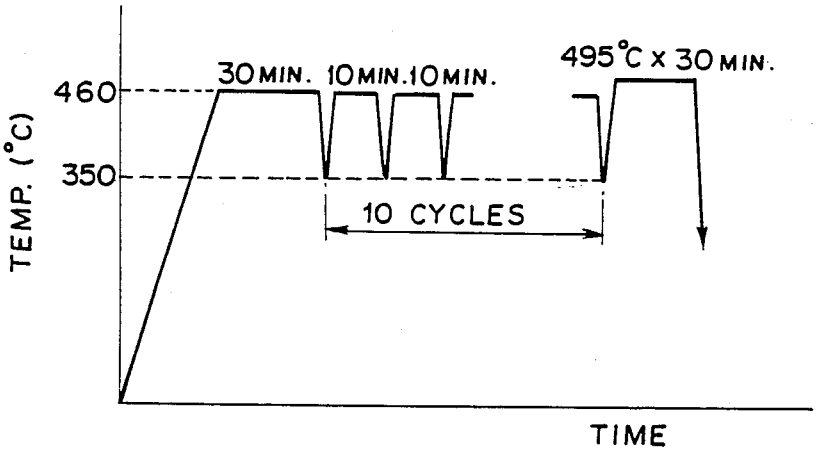
FIG. 5 is a view for illustrating the heat treatment employed in the embodiment.
Figure 4G:
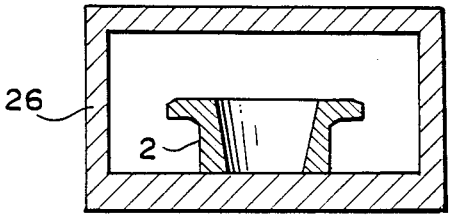

Thereafter, the valve spring upper seat 2 was placed in a heat treating oven 26 as shown in FIG. 4*g*, and was subjected to a heat treatment including twelve heating-and-cooling cycles as shown in FIG. 5. As shown in FIG. 5, in the first heating-and-cooling cycle, the valve spring upper seat 2 was heated to 460° C. and then cooled to 350° C. by air-cooling after being held at 460° C. for 30 minutes. In each of the second to eleventh heating-and-cooling cycles, the valve spring upper seat 2 was heated to 460° C. and then cooled to 350° C. by air-cooling after being held at 460° C. for 10 minutes. In the twelfth heating-and-cooling cycle, the valve spring upper seat 2 was heated to 495° C. and then hardened with water as the solution treatment after being held at 495° C. for 30 minutes.

The heating rate in each of the twelve heating-and-cooling cycle may be set freely.

By the solution treatment, a supersaturated solid solution of Cu in aluminum can be obtained, and the subsequent hardening and the lapse of time will provide age-hardening. Though the repeating time by which the heating-and-cooling cycle is repeated is preferably 5 to 10 as described above, the repeating time may be set according to the required resistance to wear since the Si particles better coarsen substantially in proportion to the repeating time. The solution treatment may be omitted. In each heating-and-cooling cycle, the valve spring upper seat may be cooled with air or water or may be cooled in the oven. In order to obtain age-hardening, it is preferred that the valve spring upper seat be subjected t aging after the last heating-and-cooling cycle. Though the valve spring upper seat was subjected to the heat treatment after machining in the embodiment described above, the machining may be effected after the heat treatment.

Figure 6:
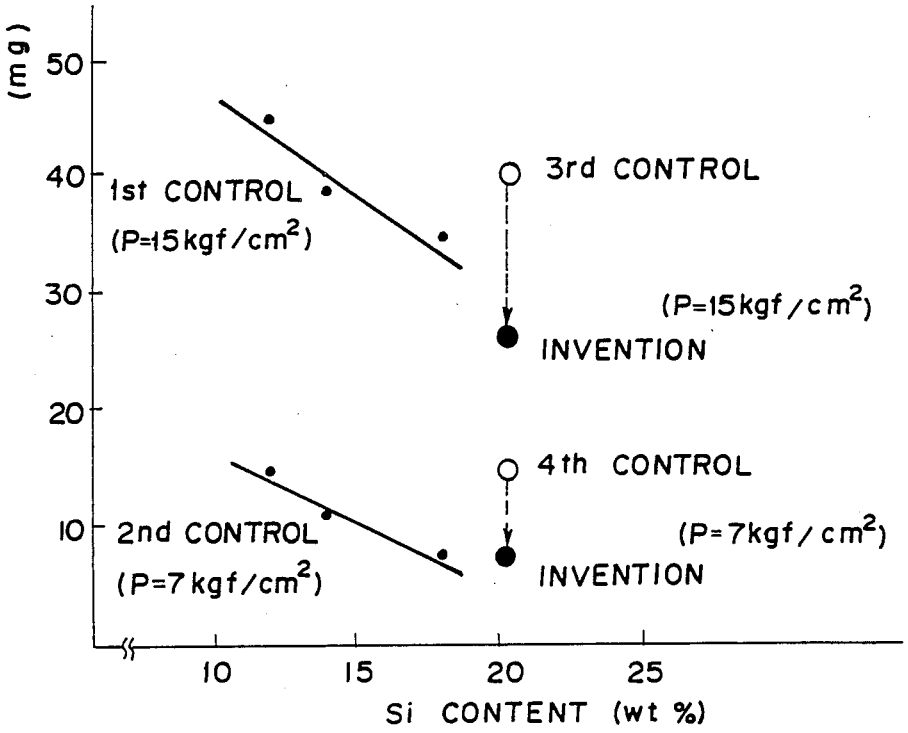
FIG. 6 shows the results of the abrasion test.

A pin was machined from the valve spring upper seat which had been obtained in the embodiment described above and was subjected to the pin-disk abrasive test together with first to fourth control pins. The first and second control pins were machined from castings of Al-Si alloys containing 2% Cu and 1% Mg and different percentages of Si. The third and fourth control pins were machined from the valve spring upper seat which had been formed in the same manner as the embodiment described above but had not been subjected to the heat treatment. The size of the pins were 10 mm×9 mm×3 mm, the disk materials were of FC35, the sliding speed was 5 m/sec., the sliding distance was 3000 m, and the pins were pressed against the disk material under pressure of 15 kgf/cm$^2$ and 7 kgf/cm$^2$ without lubricant. The results were as shown in FIG. 6. As can be understood from FIG. 6, the pins manufactured in accordance with the present invention exhibited excellent resistance to wear.

Figure 7A:
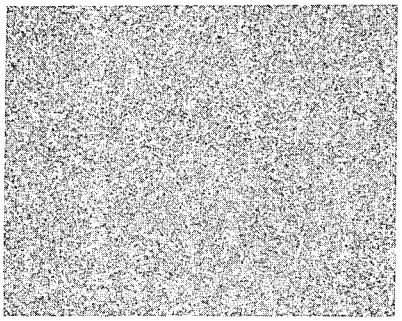
FIG. 7*a* is an enlarged (×400) photograph of the aluminum alloy structure in the valve spring upper seat which has not been subjected to the heat treatment and has only been subjected to aging.
Figure 7B:
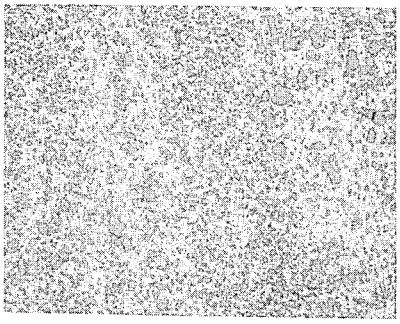
FIG. 7*b* is an enlarged (×400) photograph of the aluminum alloy structure in the valve spring upper seat which has been subjected to the heat treatment including six heating-and-cooling cycles and has been subjected to aging.
Figure 7C:
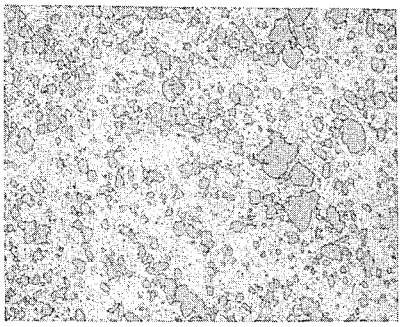
FIG. 7*c* is an enlarged (×400) photograph of the aluminum alloy structure in the valve spring upper seat which has been subjected to the heat treatment including twelve heating-and-cooling cycles (the twelfth heating-and-cooling cycle being as the solution treatment) and has been subjected to aging.

FIG 7*a* is an enlarged (×400) photograph of the aluminum alloy structure in the valve spring upper seat which has not been subjected to the heat treatment and has only been subjected to aging (T6 aging), FIG. 7*b* is an enlarged (×400) photograph of the aluminum alloy structure in the valve spring upper seat which has been subjected to the heat treatment including six heating-and-cooling cycles and has been subjected to aging, and FIG. *7c* is an enlarged (×400) photograph of the aluminum alloy structure in the valve spring upper seat which has been subjected to the heat treatment including twelve heating-and-cooling cycles (the twelfth heating-and-cooling cycle being as the solution treatment) and has been subjected to aging. In the photographs, the gray particles and agglomerates are crystals of Si. In the aluminum alloy structure shown in FIG. *7a,* the Si particles are very fine (the mean particle size being 3 to 5 μm and the maximum particle size being 8 μm), in the aluminum alloy structure shown in FIG. *7b,* the Si particles have substantially coarsened, and in the aluminum alloy structure shown in FIG *7c,* the Si particles have been remarkably coarsened (the mean particle size being 10 to 12 μm and the maximum particle size being 30 μm).

As can be understood from the description above, in accordance with the embodiment described above, the valve spring upper seat is heat-treated at low temperatures not higher than 460° C., and accordingly blisters are not formed. Though the heating-and-cooling cycle is repeated a plurality of times, the total time requirement is relatively short and accordingly the heat energy consumption can be substantially reduced. Further, since the Si particles are coarsened after the forging, the valve spring upper seat can be compression-molded with the aluminum alloy containing fine Si particles and being easy to process.

I claim:

1. A method of manufacturing a hardwearing aluminum alloy part comprising the steps of preforming quench-solidified Al-Si alloy powder which contains more than 12 wt % Si, compression-molding the preforming into an aluminum alloy part, and repeating a plurality of times a heating-and-cooling cycle of heating the aluminum alloy part to a temperature between 440° C. and 500° C. and cooling it to a temperature not higher than 380° C.

2. A method of manufacturing a hardwearing aluminum alloy part as defined in claim 1 in which the heating-and-cooling cycle is repeated more than five times.

3. A method of manufacturing a hardwearing aluminum alloy part as defined in claim 1 in which said aluminum alloy part is held at a temperature between 440° C. and 500° C. for at least 30 minutes in the first heating-and-cooling cycle.

4. A method of manufacturing a hardwearing aluminum alloy part as defined in claim 3 in which said aluminum alloy part is held at a temperature between 440° C. and 500° C. for at least 10 minutes in the second and later heating-and-cooling cycles.

5. A method of manufacturing a hardwearing aluminum alloy part as defined in claim 4 in which said aluminum alloy part is held at a temperature between 440° C. and 500° C. in the first heating-and-cooling cycle for a time longer than that in the second and later heating-and-cooling cycles.

6. A method of manufacturing a hardwearing aluminum alloy part as defined in claim 1 in which said aluminum alloy part is heated to the same temperature in all the heating-and-cooling cycles.

7. A method of manufacturing a hardwearing aluminum alloy part as defined in claim 6 in which said aluminum alloy part is cooled to the same temperature in all the heating-and-cooling cycles.

* * * * *